United States Patent [19]

Graves, Jr. et al.

[11] Patent Number: 4,730,629

[45] Date of Patent: Mar. 15, 1988

[54] PROCESS FOR PROVIDING TOBACCO EXTENDER MATERIAL

[75] Inventors: William H. Graves, Jr., Pfafftown; Gerard E. Leonard, Kernersville, both of N.C.

[73] Assignee: R. J. Reynolds Tobacco Company, Winston-Salem, N.C.

[21] Appl. No.: 840,260

[22] Filed: Mar. 17, 1986

[51] Int. Cl.[4] ..... A24B 3/14

[52] U.S. Cl. ..... 131/369; 131/370; 131/375

[58] Field of Search ..... 131/369, 370, 371, 372, 131/373, 374, 375

[56] References Cited

U.S. PATENT DOCUMENTS

| | | |
|---|---|---|
| 2,708,175 | 5/1955 | Samfield et al. . |
| 2,845,933 | 8/1958 | Samfield et al. . |
| 3,053,259 | 9/1962 | Parmele et al. . |
| 3,076,729 | 2/1963 | Garbo . |
| 3,209,763 | 10/1965 | Parmele et al. . |
| 3,746,012 | 7/1973 | Deszyk ..... 131/370 |
| 3,932,081 | 1/1976 | Buchmann et al. . |
| 4,164,948 | 8/1979 | Beringer et al. . |
| 4,325,391 | 4/1982 | Schmidt . |
| 4,347,855 | 9/1982 | Lanzillotti et al. . |
| 4,391,285 | 7/1983 | Burnett et al. . |
| 4,421,126 | 12/1983 | Gellatly . |
| 4,510,950 | 4/1985 | Keritsis et al. . |
| 4,598,721 | 7/1986 | Stiller et al. . |
| 4,625,737 | 12/1986 | Keritsis et al. . |
| 4,646,764 | 3/1987 | Young et al. . |

FOREIGN PATENT DOCUMENTS

| | | |
|---|---|---|
| 1532042 | 12/1977 | Fed. Rep. of Germany . |

*Primary Examiner*—V. Millin

[57] ABSTRACT

Tobacco extender material is provided in sheet-like form by contacting tobacco material and/or carbonized material in substantially dry form with a binding agent in substantially dry form, and then subjecting the mixture to a high rate of shear agitation in the presence of a relatively low moisture content. The level of moisture is sufficient to provide activation of the binding agent. The material so processed is further processed using dry forming techniques in order to provide sheets of reconstituted tobacco material and sheets of carbonized material. The sheets of tobacco extender can be cut to the desired size and is useful in the manufacture of cigarettes.

20 Claims, 11 Drawing Figures

PROCESS FOR PROVIDING TOBACCO EXTENDER MATERIAL

BACKGROUND OF THE INVENTION

This invention relates to methods for making tobacco products, and in particular, to methods for making reconstituted tobacco products and other tobacco extender materials under conditions of relatively low moisture levels.

When tobacco leaf is processed for use in smoking products and when tobacco products are manufactured, a substantial amount of scrap or waste tobacco is provided. Scrap or waste tobacco can be in the form of tobacco dust (typical particle size is less than about 60 Tyler mesh), tobacco fines (typical particle size is between about 20 Tyler mesh and about 60 Tyler mesh), tobacco stems, or processed tobacco which remains unused after tobacco product manufacture is interrupted or completed. As scrap or waste tobacco frequently is of high quality, it is highly desirable to reclaim or reconstitute such scrap or waste tobacco. For example, it is desirable to provide reclaimed or reconstituted tobacco in sheet or strand form, and to blend the reclaimed or reconstituted tobacco with tobacco leaf or cut filler in order to provide a resultant cut filler. The resulting cut filler is used in the manufacture of cigarettes (eg., in the manufacture of cigarette rods).

Various methods for providing reclaimed, reformed, reassembled or reconstituted tobacco are known. For example, tobacco materials can be mixed with relatively large amounts of water, processed, and dried. U.S. Pat. No. 1,068,403 discloses a process for the production of so-called artificial tobacco leaves by which tobacco veins are mixed with water in order to form a pulp, and the pulped veins are further processed. However, the method disclosed in U.S. Pat. No. 1,068,403 requires the use of relatively large amounts of water and undesirable subsequent drying steps.

U.S. Pat. No. 3,053,259, discloses another method for reclaiming tobacco fragments or tobacco fines. For example, tobacco material is ground to a very small size using a hammer mill or ball mill; the ground tobacco is moistened or mixed with a binder; and filamentary shreds are press formed or molded by passing the resulting mixture between a smooth surface roller and a grooved roller. However, the disclosed method requires the pre-grinding of material as well as the use of relatively large amounts of moisture, especially when a binder is not employed.

Other known methods for reclaiming tobacco material typically involve contacting tobacco material with binder and slow mixing the mixture using ribbon mixing devices or tumbling drums usually in combination with relatively great amounts of heat and/or moisture. However, it would be desirable to reclaim tobacco material in a fairly rapid fashion without the necessity of applying relatively large amounts of moisture and/or heat.

As there is a need for a process for regenerating tobacco waste products, it would be highly desirable to provide an efficient and effective process for providing tobacco extender such as reclaimed tobacco in a sheet-like form. In particular, it is desirable to provide tobacco extender such as reclaimed tobacco using a process which requires neither the use of a relatively large amount of water and subsequent post drying of product, nor the application of external heat, nor lengthly processing steps.

SUMMARY OF THE INVENTION

In one aspect, this invention is a process for providing tobacco extender in sheet-like form, said process comprising the steps in combination (a) providing tobacco material, carbonized material or blend thereof (hereinafter referred to as "filler material"), and (b) providing in essentially dry, substantially non-binding form, binding agent which is capable of being activated, and (c) contacting the filler material and the binding agent, and then (d) subjecting the filler material and binding agent to high shear agitation (i) in the presence of sufficient moisture to provide activation of the binding agent but in the presence of a moisture content of less than about 30 weight percent based on the total weight of moisture and filler material, and (ii) for a period of time sufficient to activate the binding agent, and then (e) forming sheet-like tobacco extender from the filler material so subjected to high shear agitation.

In another aspect, this invention is a process for providing sheet-like tobacco extender, whereby a flavorant is incorporated into the filler material so subjected to high shear agitation.

In a preferred aspect, this invention is a process for providing tobacco extender in sheet-like form, the process comprising forming sheets of tobacco extender from the filler material so subjected to high shear agitation by (i) passing the filler material through the nip of a first pressurized roller system having two rollers exhibiting a nip zone pressure sufficient to provide compression of said filler material thereby providing compressed, admixed filler material, wherein at least one of the roller faces comprises a series of grooves, the series extending longitudinally along the roller and each groove extending about the periphery of the roller, wherein each groove has a maximum width near the surface of the roller and a minimum width near the bottom of the groove, and then (ii) forming under pressure tobacco extender in sheet-like form by passing the compressed, admixed filler material through the nip of a second pressurized roller system having two rollers exhibiting a nip zone pressure sufficient to provide the tobacco extender.

In another preferred aspect, this invention is a process for providing tobacco extender in sheet-like form, wherein the second pressurized roller system has two rollers exhibiting a nip zone pressure sufficient to provide the tobacco extender, wherein the roller faces of the rollers are positioned in a spaced apart relationship in the region along the rollers where the reclaimed tobacco material is formed, and wherein the spaced apart relationship between the faces of the rollers provides a sufficient distance therebetween to provide formed sheet-like tobacco extender.

Surprisingly, the invention allows for the reclamation of tobacco in an efficient and effective manner in a short period of time using a process which requires neither relatively large amounts of moisture nor relatively large amounts of binder. Depending upon factors such as the binding agent used, the process of this invention can be performed at or near ambient temperatures without the necessity of the application of external heat. If desired, the process of this invention can be performed without chemical or physical pretreatment of the tobacco.

The reclaimed tobacco extender and tobacco extender incorporating carbonized material can be employed as is known in the art. For example, the tobacco extender material provided by the process of this invention can be dried or moistened, treated with additives, blended with other tobacco products, cut to the desired size, etc. The resulting tobacco extender is most useful in the manufacture of cigarettes.

DETAILED DESCRIPTION OF THE EMBODIMENTS

Figure 1:
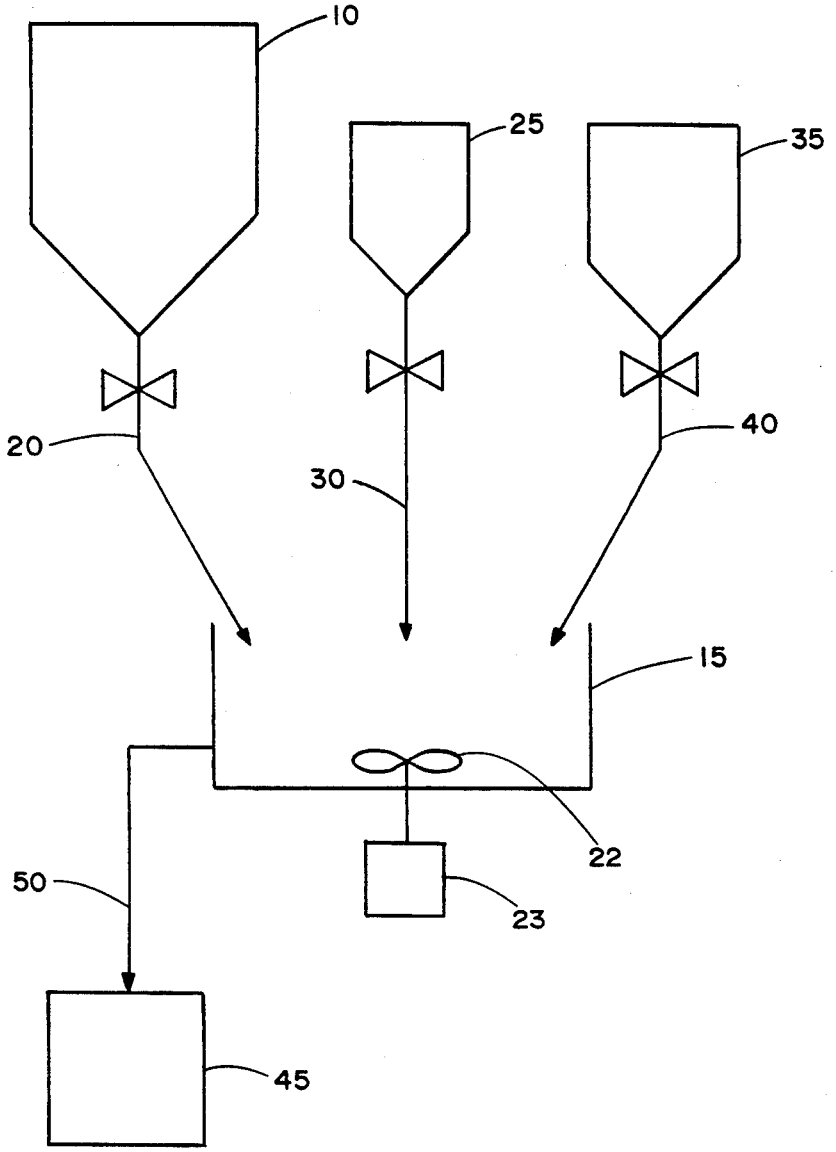
FIG. 1 is a schematic diagram of one embodiment of the processing steps of this invention.

In FIG. 1, container 10 is a storage bin, crate, vessel, hopper, or the like containing tobacco material, carbonized material, or combination thereof. For purposes of this invention tobacco material, carbonized material and blends thereof are collectively referred to hereinafter as "filler material." Filler material present in container 10 is transferred to mixing apparatus 15 (described in detail hereinafter) by way of conveying means 20 such as a conveyor belt, a transfer line, simple pouring or dumping device, or the like. Generally, the mixing apparatus is a high shear device having a shearing means 22 such as blades, knives, or the like, and a power source 23 for powering said shearing means. Container 25 is a transfer vessel, drum, or the like containing binding agent (described in detail hereinafter) which can be transferred to the mixing apparatus by way of conveying means 30 such as a conveyor belt, a transfer line, simple pouring or dumping device, or the like. Container 35 is a transfer vessel, drum, or the like containing moisture in the form of water which can be transferred to the mixing apparatus by way of transfer means 40 such as transfer line, simple pouring or dumping device, or the like. The amounts and type of filler material, binding agent and moisture and the method of transfer thereof to the mixing apparatus are described in further detail hereinafter. The filler material, binding agent and moisture are subjected to high shear agitation in the mixing apparatus, and the resulting filler material is transferred to sheet forming apparatus 45 (described in detail hereinafter) by way of conveying means 50 such as a transfer line, conveyor belt, simple pouring or dumping device, or the like. The sheet forming apparatus provides a means for further processing the filler material using dry forming techniques in order to provide strands of tobacco extender in sheet-like form.

The tobacco material useful in this invention can vary and typically includes tobacco dust, tobacco fines, tobacco laminae, scrap tobacco which is recovered from various processing stages and cigarette manufacture stages, scraps and/or sheets of wet formed reconstituted tobacco (for example in dry form), scraps and/or sheets of dry formed reconstituted tobacco, tobacco leaf stems, and tobacco stems and stalks. The sizes of the various pieces or particles of tobacco material employed as filler material are not particularly critical. Various types of tobaccos and blends thereof can be employed as tobacco material according to this invention.

Carbonized material useful in this invention can vary and typically includes carbonized organic materials including carbonized wood (eg., oak, hickory, and other hardwoods) such as in the form of chips or sawdust, carbonized pieces of coconut shells, carbonized tobacco stems and stalks, carbonized peanut shells, carbonized oak leaves, and the like. Typically carbonized materials are materials derived from cellulosics and have a low inorganic content. Carbonized materials are provided using generally known techniques such as heating the material in a closed or inert (e.g., nitrogen) atmosphere. Carbonized materials employed in this invention can be in the form of particles having a range of sizes, typically ranging from powder or dust to stem like pieces of about 2 inches by about 0.25 inch. No pre-grinding of the carbonized material is necessary for use in the process of this invention. The carbonized material can be employed as filler material in a form wherein all particles are substantially equal in size, or in a form wherein the particles have a range of sizes.

As used herein the term "tobacco extender" is meant to include the resulting material in sheet-like form which is provided according to the process of this invention. The tobacco extender can be provided from tobacco material and/or carbonized material. For example, tobacco material and carbonized material can be blended and employed as filler material in the process of this invention. The amount of tobacco material relative to carbonized material can range from 0 weight percent to 100 weight percent tobacco material, and from 100 weight percent to 0 weight percent carbonized material. When blends of tobacco material and carbonized material are employed, it is preferable to provide from about 25 to about 75 percent tobacco material and from about 25 to about 75 percent carbonized material, based on the total weight of the blend.

A binding agent (i.e., binder) is employed in the process of this invention and is most preferably a binding agent which is capable of being water or moisture activated. Examples of suitable binding agents include carboxymethylcellulose, sodium carboxymethylcellulose, carboxyhydroxy methylcellulose, guar gum, carragrenan gum, xanthan gum, locust bean gum, hydroxylethyl amylose, tobacco extracts, sodium alginate, a binder sold commercially as Bermocoll E270G by Berol Kemlab, and the like, as well as combinations thereof such as a blend of carboxymethylcellulose and guar gum, or a blend of xanthan gum with locust bean gum.

The amount of binding agent which is employed relative to the filler material can vary depending upon factors such as the type of binding agents, the moisture content of the filler material, the temperature at which the filler material and binding agent are subjected to the high rates of shear agitation, and other such factors. Typically relatively low amounts of binder are employed. It is preferable to employ less than about 15 weight percent, most preferably less than about 10 weight percent binding agent, based on the total weight of binding agent, moisture and filler material dry weight.

The filler material and binding agent are contacted and subjected to a high rate of shear agitation. The manner in which the filler material and binding agent are contacted can vary and is not particularly critical. For example, the filler material and binding agent each can be added bulk-wise to the apparatus which provides the high rate of shear agitation. Preferably the binding agent is employed in a substantially dry form when contacted with the substantially dry filler material, the binding agent is dispersed (e.g., mixed) with the filler material, and any moisture which may be necessary is then added to the filler material either prior to or during high shear agitation of the filler material.

As used herein the term "high rate of shear agitation" is meant to include that agitation which is sufficiently high in order to provide activation of the binding agent which is contacted with the filler material in a relatively short period of time without the necessity of subjecting the filler material and binding agent to temperatures significantly greater than ambient temperature and without the necessity of subjecting the filler material and binding agent to moisture greater than about 30 weight percent, based on the total weight of filler material and moisture. Typical high agitation rates exceed about 800 rpm, and preferably exceed about 1100 rpm as determined for a commercially available Hobart HMC-450 mixing device. The high rates of agitation can provide very rapid movement of the shearing means such as knives, blades, paddles, propellors, and the like. The time period over which the filler material and binding agent are subjected to the high rate of shear agitation can vary and can be as long as desired, but typically is less than about 10 minutes, more preferably between about 3 minutes and about 6 minutes. Typically the filler material and binding agent are subjected to the high rate of shear agitation at a temperature in the range from about 65° F. to about 110° F., although other temperature ranges ca be employed. It is believed that the high rate of shear agitation provides good dispersion of the binding agent relative to the filler material, and that the shear agitation provides shear energy which may provide activation of the binding agent.

As used herein the term "activation" in referring to the binding agent is meant to include the introduction of the latent adhesive properties to the binding agent. Such introduction of adhesive properties can be provided by application of heat, moisture, pressure, shear energy, or the like. In particular, the binding agent loses its substantially dry character and behaves substantially as an adhesive which is capable of adhering the filler material together. The filler material which has been subjected to high shear agitation according to this invention generally exhibits a formable, somewhat consistent character and can be somewhat tacky in nature.

High rates of shear agitation can be provided using an apparatus such as a high intensity mixer, a homogenizer, a blender, a high shear extruder, or other high shear device. For example, from about 50 g to about 300 g of filler material can be subjected to high shear mixing using a commercially available Waring Blender set at medium speed for about 5 minutes or high speed for about 3 minutes, while periodically scrapping the sides of the mixing container with a device such as spatula in order to minimize cavitation of filler material and promote adequate thorough mixing. As another example, from about 1 kg to about 7 kg of filler material can be subjected to high shear mixing using a commercially available Hobart HMC-450 Mixer having the timer set at high speed for about 5 minutes. As another example, a high shear extruder providing the necessary shearing such as can a commercially available single or double screw extruder can be employed.

The moisture content of the filler material can vary. Typically, a low moisture content filler requires a relatively greater amount of force in order to ultimately provide tobacco extender materials; while a high moisture content requires the undesirable and energy intensive drying processes attendant in conventional water based reconstituted tobacco processes. Typically, the filler material which is employed at some stage in the process steps of this invention exhibits a moisture content of at least about 12 weight percent, preferably at least about 15 weight percent; while the upper limit of the moisture content is less than about 30 weight percent, and typically is as great as about 25 weight percent, preferably as great as about 18 weight percent, based on the dry weight of the filler material and total moisture. Typically, higher amounts of moisture permit the use of lower amounts of binding agent. Most preferably, the moisture content of filler material is not increased above about 18 weight percent prior to the time that the filler material and binding agent are contacted and blending thereof is commenced. It is believed that moisture imparts a softening of tobacco material as well as providing a material having a pliability sufficiently low to allow for the utilization of a desirable force during the tobacco extender forming process. It is desirable that the moisture content not be overly high as to require excessive drying of the resulting tobacco extender, or as to cause an undesirable pliability of filler material and provide a tobacco extender of relatively poor tensile strength.

The process of this invention provides an efficient and effective means for incorporating water and/or temperature sensitive flavorants into the tobacco extender. For example, certain flavorants such as tobacco extracts, vanillin, chocolate, licorice, and the like can be blended with the filler material, binding agent and/or moisture. As the process of this invention can be performed at ambient temperatures the desirable characteristics of the flavorants are not lost due to degradation or chemical transformation caused by high temperatures. In addition, as the process of this invention is performed using relatively low moisture levels and relatively low amounts of liquid water are removed from the processed filler material, only relatively small amounts of moisture sensitive and/or water soluble flavorants are lost during processing stages.

Figure 2:
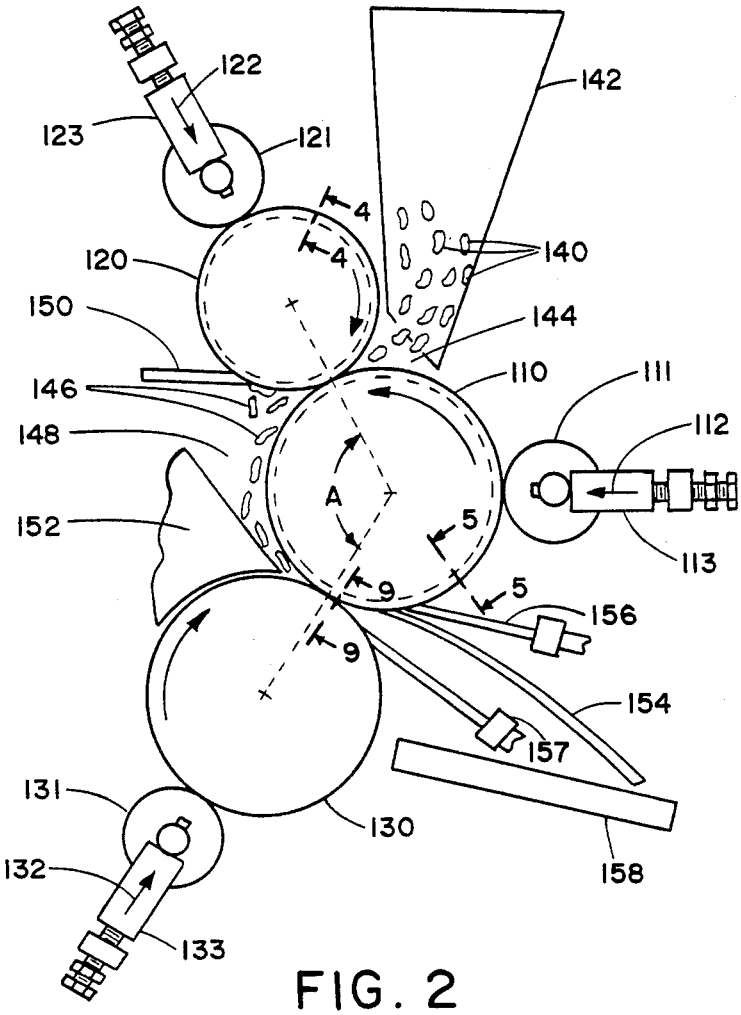
FIG. 2 is a diagrammatic illustration of one embodiment of a portion of the process of this invention showing the two pressurized roller systems and filler material processed to reclaimed sheet form tobacco extender material.
Figure 3:
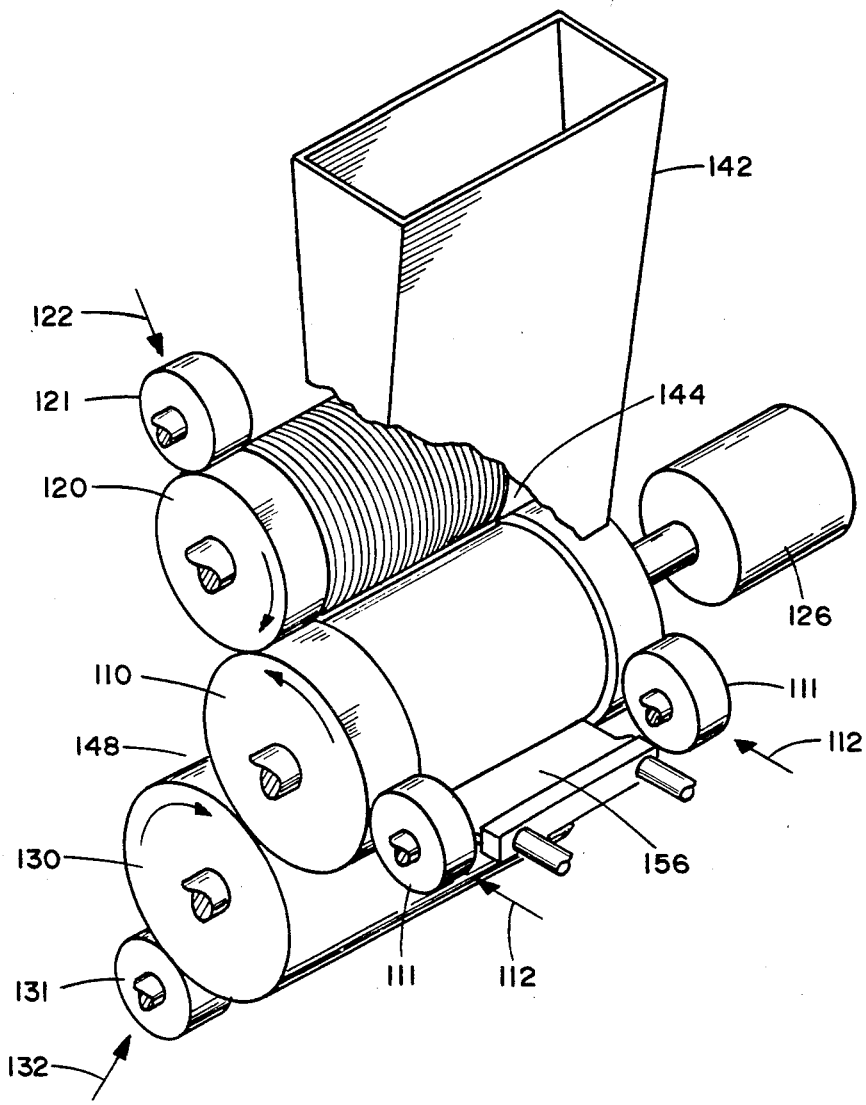
FIG. 3 is a perspective of an apparatus useful in the process of this invention showing the preferred pressurized roller systems and the means for removing reclaimed tobacco material from the roller face of a roller of the second pressurized roller system.

FIGS. 2 and 3 illustrate an apparatus for conducting a portion of the process of this invention. The sheet forming apparatus which is illustrated is particularly useful for providing sheet-like material from filler material, binding agent and optional flavorant which have been subjected to high shear agitation using the high shear mixing device. The sheet forming apparatus comprises a first pressurized roller system and a second pressurized roller system. As used herein, the term "pressurized roller system" means two rollers in roll contact and exhibiting a nip zone pressure sufficient to provide compression of filler material which passes therethrough into a more compressed form. The apparatus includes roller 110 which is a common roller to each of the first and second pressurized roller systems. The first pressurized roller system includes substantially cylindrical roller 110 and another substantially cylindrical roller 120 in roll contact with one another. By the term "roll contact" is meant that two rollers aligned with roll faces essentially parallel to each other have the roll faces thereof in contact with one another for a distance along the length of each roller, and whereby each roller is capable of being rotated about the longitudinal axis of each roller. Each of the rollers forming the first pressurized roller system are mounted such that the aforementioned roll contact of roller 110 with roller 120 is substantially maintained during the process of the invention. Force is applied to each of roller 110 and roller 120 by compression rollers 111 and 121, respectively in roll contact with each of rollers 110 and 120. The force is provided in a direction shown schematically by arrow 112 and arrow 122, respectively. The force can be provided to rollers 111 and 121 by jack screws 113 and 123, respectively. Alternative force providing means can include hydraulic cylinders, or the like. Alternatively, the force providing means can be compression springs, tension springs, or the like. Preferably, two compression rollers are positioned on each roller of the pressurized roller system and are positioned towards the end of the roller with which the compression rollers are in roll contact (as shown in FIG. 3). Typically, each of the two such compression rollers have diameters and a combined longitudinal length less than that of the roller with which the compression rollers are in roll contact. The jack screw is positioned on each compression roller. Each of rollers 110 and 120 are rotated in the direction indicated by the arrows within the rollers. The rollers are rotated in opposite directions relative to one another in order that the tobacco material can be passed through the nip of the rollers. Each of the rollers can be driven using a power source 126 (shown in FIG. 3) such as a variable speed motor (e.g. an electric motor having from about 1 to about 5 horsepower) which turns the rollers by a series of drive gears (not shown). The rollers are supported by support means such as a frame (not shown) to a chassis (not shown).

The second pressurized roller system includes roller 110 and another substantially cylindrical roller 130 in roll contact with one another. Each of the rollers forming the second pressurized roller system are mounted such that the aforementioned roll contact of roller 110 with roller 130 is substantially maintained during the process of this invention. Force is applied to each of roller 110 and 130 by compression rollers 111 and 131 in roll contact with each of rollers 110 and 130, respectively. The force is provided in a direction shown schematically by arrow 112 and arrow 132, respectively. The force can be provided to rollers 111 and 131 by jack screws 113 and 133, respectively. Compression roller 131 and force providing means 133 are positioned as are the compression rollers and force providing means described hereinbefore. Each of rollers 110 and 130 are rotated in the direction indicated by the arrows within the rollers. The rollers are rotated in opposite directions relative to one another in order that the tobacco material can be passed through the nip of the rollers. Each of the rollers can be driven using a power source 126 (shown in FIG. 3) which turns the rollers by a series of drive gears (not shown). The rollers are supported by support means such as a frame (not shown) to a chassis (not shown).

Rollers positioned relative to one another in the configuration shown in FIG. 2 form angle A which can be defined as that angle formed by the roll axis (i.e., the longitudinally extending axis) of each of rollers 120, 110 and 130, respectively. The value of angle A can depend upon a variety of factors including the diameters of the various rollers. Typically, angle A ranges from less than 180° to a limiting angle defined by the diameter of the rollers, and preferably ranges from about 90° to about 150°.

In an embodiment shown in FIGS. 2 and 3, roller 130 has a substantially smooth (i.e., non-grooved) roller face; and roller 120 contains the series of grooves therein. The series extends longitudinally along the roller wherein each groove extends about the periphery of the roller. Roller 110 (which is in roll contact with both of rollers 120 and 130) comprises either a groove extending along the longitudinal axis of the roller and around the periphery of the roller in the region where the sheet-like material ultimately is provided, or a means such as spacer bearings (shown in FIG. 10) positioned at the ends of roller 10 in order to provide the required spaced apart relationship between the roller faces in the region where the sheet-like material ultimately is provided.

When compression rollers are employed at each end of the roller system rollers in order to provide the required nip zone pressures to the roller systems, it is most preferable that the grooved rollers have grooves positioned along the longitudinal length of the roller only in the region between the compression rollers (i.e., the roll ends are not grooved).

The forces between the rollers which typically are required in the process of this invention can vary, but are those forces which are great enough to generate sufficient roller nip zone pressures in order to provide ultimately tobacco extender materials in a sheet-like form. That is, sufficient nip zone pressures are those sufficient to provide shearing, mixing, and forming of said filler material, and can be as great as is desired. Typically, forces between rollers of at least about 3,000, and as great as about 10,000, preferably about 4,000 to about 6,000 pounds per linear inch, are great enough to generate sufficient roller nip zone pressures. Typically, the rollers are constructed of a metal material such as hardened carbon steel or hardened alloy steel, or other material sufficient to withstand the compression.

The sizes of the various rollers can vary. Typically, roller diameters range from about 3 inches to about 8 inches, preferably about 6 inches to about 8 inches; while roller lengths range from about 4 inches to about 12 inches. Rollers forming the two roller systems can each have diameters which are equal, or the diameters of the various rollers can differ. Rotational roller speeds range, for example, from about 4 rpm to about 30 rpm.

Operation of the apparatus of FIGS. 2 and 3 involves feeding the activated filler material 140 (i.e., which has been subjected to high rates of shear agitation under conditions sufficient to provide activation of the binding agent) by hopper 142 (which is shown as partially cut away in FIG. 3) to feed zone 144 which in turn feeds the filler material to the nip of rollers 110 and 120. The mixed and pre-formed filler material 146 which passes through the first pressurized roller system and then is fed into zone 148 which feeds the filler material to the second roller system. The filler material exiting the first roller system can have a tendency to stick to the rollers, and the material can be removed from the rollers (particularly roller 120 as shown in FIG. 2) by scrape 150. Scrape 150 can be a series of needles, a comb-like configuration, a corrugated metal sheet, metal finger-like materials, or a knife-like means such as a doctor blade positioned against the length of the face of the roller so as to remove (i.e., scrape) the tobacco material from the face of the roller. Most preferably, scrape 150 is positioned non-tangentially to the surface of the roller. For example, scrape 150 is positioned against the face of roller 120 circumferentially at a location on the surface of the roller within an arc of about 10° to about 45° relative to the point at which rollers 110 and 120 meet in roll contact. Preferably, the scrape is positioned substantially parallel (i.e., within an angle of about 15°) relative to the tangent of the rollers formed by the point of the roll contact of rollers 110 and 120. Scrape 150 is attached to the chassis or frame of the apparatus (not shown) in order to maintain the positioning thereof against the face of the roller. If desired, zone 148 can be employed as an auxiliary feed zone where filler material, particularly small particle size material such as tobacco dust and/or tobacco fines, can be added to the mixed and pre-formed filler material 146 exiting the first roller system into zone 148. In particular, the compressed, admixed filler material 146 can be contacted with tobacco dust and/or tobacco fines in zone 148. Zone 148 can include slide 152 which is a hopper, feed or other such means for directing filler material 146 in the second pressurized roller system. The filler material 146 in zone 148 which has been mixed and pre-formed under pressure in the first pressurized roller system is generally a macerated, ground or pressed filler material having some characteristics of tobacco extender material.

Filler material 146 is further formed under pressure into the desired sheet form material by passing filler material 146 through a subsequent second pressurized roller system (i.e., through the nip of rollers 110 and 130). Tobacco extender material 154 exits the second roller and can be removed from the surface of roller using scrape 156. Scrape 156 is attached to the chassis or frame of the apparatus (not shown) in order to maintain the positioning thereof against the face of roller 110.

Tobacco extender material in sheet-like form can be provided through the assistance of scrape 156 having the form of a doctor blade or other such means positioned against the face of the roller 110 and extending along the face of the roller. Scrape 156 is positioned along that portion of the length of the roller wherein tobacco extender material tends to stick to the roller. Scrape 156 is most preferably positioned non-tangentially to the roller. For example, as shown in FIG. 2, scrape 156 is positioned against the face of roller 110 at a circumferential location on the surface of the roller within the arc of about 10° to about 30° relative to the point at which rollers 110 and 130 meet in roll contact and thereby are positioned in a spaced apart relationship. Preferably, the scrape is positioned substantially parallel (i.e., within an angle of about 15°) relative to the tangent of the rollers formed by the roll contact of rollers 110 and 130. Scrape 157 (shown in FIG. 2) provides a means for removing tobacco extender material from the surface of smooth roller 130. Scrape 157 is a doctor blade or other such means positioned against the face of the roller. Scrape 157 is positioned against the face of roller 130 in much the same manner as scrape 156 is positioned against roller 110. Tobacco extender material 154 can be directed from the apparatus by collection bin 158 or other removal means, and then collected.

Figure 4:
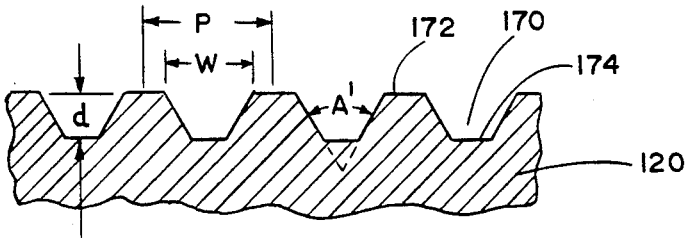
FIG. 4 is an enlarged, partial sectional view of of a roller taken along line 4—4 in FIG. 2 and showing a series of grooves, each groove extending circumferentially about the periphery of the roller.

FIG. 4 illustrates a series of grooves 170 positioned along a roller, and each groove has a top portion 172 (i.e., towards the surface of the roller face) and a bottom portion 174 (i.e., toward the inner portion of the roller). The series of grooves extends longitudinally along roller 120 or a portion thereof. The grooves 170 can be incorporated into roller 120 of the first pressurized roller system by techniques such as machining using a suitable lathe. Each groove completely circumscribes roller 120. Preferably each groove has a shape substantially similar to the other grooves which extend along the roller. The grooves can extend about the roller in a radial fashion, a helical fashion, or the like. Preferably, the grooves each circumscribe the roller substantially transversely relative to the longitudinal axis of the roller. Top portion 172 is flattened and typically ranges in width from about 0.010 inch to about 0.015 inch. Generally, the flattened top portion 72 is narrow enough so as to not require excessive force in order to maintain roller contact in the pressurized roller system; while flattened top portion 172 is wide enough as to not deform to a substantial extent under typical nip zone pressures. Bottom portion 174 can be rounded or flattened (as illustrated in FIG. 4). When flattened, bottom portion 174 typically ranges in width from about 0.003 inch to about 0.007 inch. Generally, bottom portion 174 is narrow enough so as to provide sufficient mixing action of the tobacco material. The mixing action is believed to be provided by the compression feeding performed by the relatively large size leaf stems which carry the tobacco particles into the grooves. Flattened bottom portion 174 is wide enough so as to permit the release of tobacco material from the surface region of the roller after processing. In particular, a bottom portion 174 which is overly narrow or pointed can tend to trap tobacco material in the groove and prevent release of the tobacco material therefrom. The depth d of the groove can vary and typically ranges from about 0.008 inch to about 0.025 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of tobacco material which is processed, the moisture content of the tobacco material, the leaf stem content of the tobacco material, the shape of the groove, and the like. The pitch is defined as that lateral distance from the the center of top portion 172 to the center of the nearest adjacent top portion 172. Typically, a pitch of about 0.02 inch (i.e., about 1/50 ) to about 0.06 inch (i.e., about 1/16 inch); preferably about 0.03 inch (i.e., about 1/32 inch) is useful for most applications. The shape of groove 170 can vary and depends upon a variety of factors. However, each groove has a maximum width near the surface of the roller and a minimum width near the bottom of the groove. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A′ of less than about 120°, can mix tobacco material suitably well; and a pressurized roller system having a roller comprising a series of grooves each having a sloping inner edge, each groove circumscribing an angle A′ of greater than about 60°, can release processed tobacco material suitably well. The preferred angle A′ ranges from about 60° to about 120°, and is most preferably about 90°.

Figure 5:
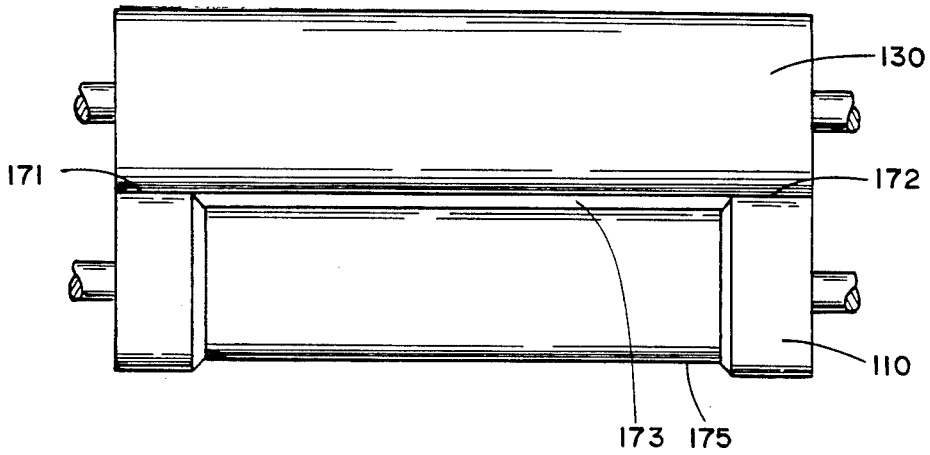
FIGS. 5–10 show various roller configurations.

FIG. 5 illustrates two rollers of the second pressurized roller system (designated as rollers 110 and 130, respectively) in roll contact with one another towards end region 171 and other end region 172 of each roller. Roller 130 has a substantially smooth surface. The roller faces of each roller are positioned in a spaced apart relationship in region 173 which extends along a portion of the longitudinal length of rollers 110 and 130. The spaced apart relationship and the corresponding region 173 is provided by groove 175 which extends longitudinally along a portion of roller 110. The groove can be incorporated into the roller by techniques such as machining using a suitable lathe. The groove completely circumscribes the roller in the region which the groove extends longitudinally along a portion of the roller. The distance which roller 110 and roller 130 are positioned in a spaced apart relationship can vary and is generally a distance which is capable of providing the sheet-like material of an acceptable thickness. Generally, the distance which roller 110 and roller 130 are positioned in a spaced apart relationship (i.e., the radial distance between the roller face of roller 110 and the roller face of roller 130 as measured in region 73) ranging from about 0.003 inch to about 0.012 inch, with about 0.006 inch preferred.

FIGS. 6, 7, 8 and 9 each illustrate other profiles for roller 110, which roller is capable of being in roll contact with another roller (not shown) at the previously described regions 171 and 172 toward each end of roller 110. Roller 110 comprises groove 175 which extends longitudinally therealong and completely circumscribes the roller in the region which the groove extends longitudinally along the portion of the roller. Typically, a groove 175 can extend from about 10 percent to about 90 percent of the longitudinal length of roller. Each of FIGS. 6, 7, 8 and 9 illustrate various aspects by which groove 175 of roller 110 can be formed.

Figure 6:
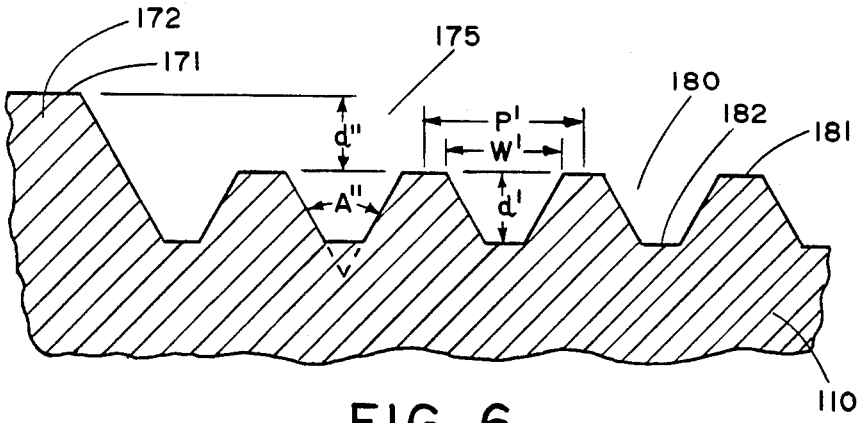

In FIG. 6, a series of grooves 180 are positioned along roller 110 within groove 175. Each groove 180 has a top portion 181 (i.e., towards the surface of the roller face) and a bottom portion 182 (i.e., toward the inner portion of the roller) within groove 175. The grooves can be incorporated into the roller by techniques such as machining using a suitable lathe. Each groove 180 completely circumscribes the roller. Preferably each groove 180 has a shape substantially similar to the other such grooves which extend along the roller. The grooves can extend about the roller in a radial fashion, a helical fashion, or the like. Preferably, the grooves circumscribe the roller substantially transversely relative to the longitudinal axis of the roller. Top portion 181 can be, for example, pointed, or flattened (as illustrated in FIG. 6). When flattened, top portion 181 typically ranges in width from about 0.008 inch to about 0.015 inch. Bottom portion 182 can be rounded or flattened (as illustrated in FIG. 6). When flattened, bottom portion 182 typically ranges in width from about 0.003 inch to about 0.005 inch. Generally, bottom portion 182 is narrow enough so as to provide further mixing action of the filler material. Flattened bottom portion 182 is wide enough so as to permit the release of filler material from the surface region of the roller after processing. In particular, a bottom portion 182 which is overly narrow or pointed can tend to trap filler material in the groove and prevent release of the filler material therefrom. The depth d′ of each groove 180 can vary and typically ranges from about 0.008 inch to about 0.020 inch. The depth is defined as the radial distance between bottom portion 182 of groove 180 and the top portion 181 of groove 180. The greatest width w′ of groove 180 can vary and typically ranges from about 0.015 inch to about 0.040 inch. The width is defined as the lateral distance measured across the groove. The pitch p′ of the groove can vary and depends upon a variety of factors including the type of filler material which is processed, the moisture content of the filler material, the shape of the groove, and the like. The pitch is defined as that lateral distance from the the center of top portion 181 to the center of the nearest adjacent top portion 181. Typically, a pitch of about 0.02 inch (i.e., about 1/50 inch) to about 0.06 inch (i.e., about 1/16 inch); preferably about 0.03 inch (i.e., about 1/32 inch) is useful for most applications. The shape of groove 180 can vary and depends upon a variety of factors. However, each groove has a maximum width near the surface of groove 180 and a minimum width near the bottom of groove 180. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A″ of less than about 120°, can mix tobacco filler suitably well; and a pressurized roller system having a roller comprising a series of grooves each having a sloping inner edge, each groove circumscribing an angle A″ of greater than about 60°, can release processed filler material suitably well. The preferred angle A″ ranges from about 60° to about 120°, and is most preferably about 90°. The depressed depth d″ of groove 175 is that radial distance measured from the outermost surface of the roller face at region 171 to the top portion 181 of groove 180. In particular, the outermost surface of top portion 181 of each groove 180 does not extend as far outward from the center of roller 110 (as measured from the longitudinal axis of the roller) as does the outermost surface of the roller face at region 171. Typically, depressed depth d″ of groove 175 varies for a particular filler material depending upon factors such as the moisture content of the tobacco material, the composition of the tobacco material, etc. Generally, depressed depth d″ ranges from about 0.003 inch to about 0.012 inch, with about 0.006 inch being preferred.

Figure 7:
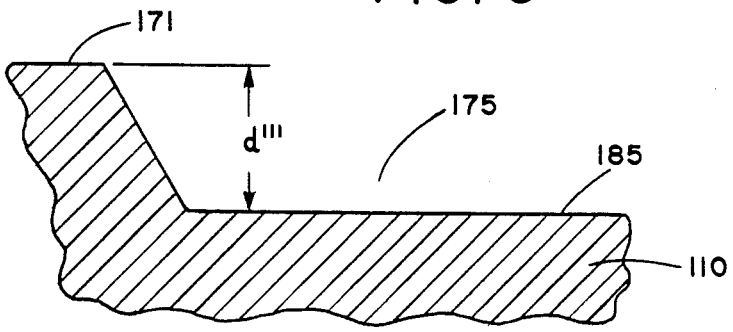

In FIG. 7, roller 110 has groove 175 extending longitudinally therealong. Groove 175 has a substantially smooth surface 185. The depressed depth d‴ of groove 175 is that radial distance measured from the outermost surface of the roller face at region 171 to surface 185 of the groove. Typically, the depressed depth of the groove is that depth which provides a reclaimed sheet-like tobacco extender material. Factors such as the tobacco extender material composition, moisture content of the composition, the properties of the binders, forces between rollers, etc., will dictate the depressed depth of the groove. Typically, the depressed depth d‴ for the embodiment shown in FIG. 7 ranges from about 0.004 inch to about 0.012 inch.

Figure 8:
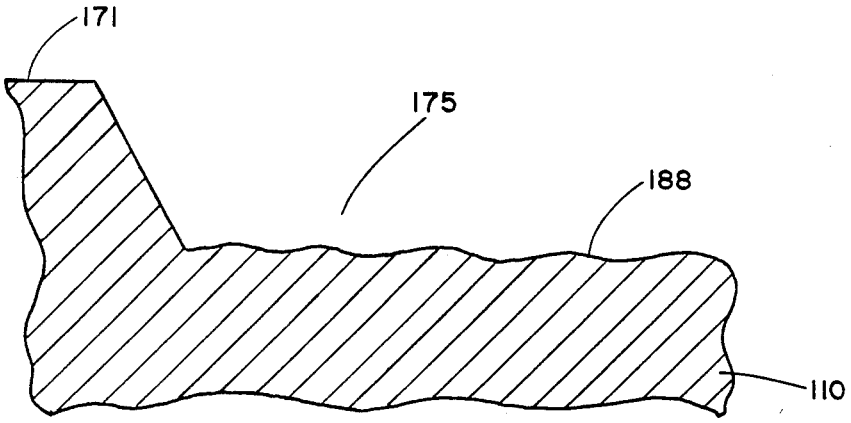

In FIG. 8, roller 110 has groove 175 extending longitudinally therealong. Groove 175 has a further recessed or uneven surface 188 which can exhibit a variety of cross sectional shapes such as sinusoidal, V-shaped, U-shaped, etc. The average depressed depth of groove 175 of this embodiment can vary and depends upon factors such as those disclosed hereinbefore the other such embodiments and is the radial distance measured from the outermost surface of the roller face at region 171 to surface 188 of the groove. The particular shape of surface 188 generally is selected in order to provide the desired surface properties to the sheet-like extender material which is provided.

Figure 9:
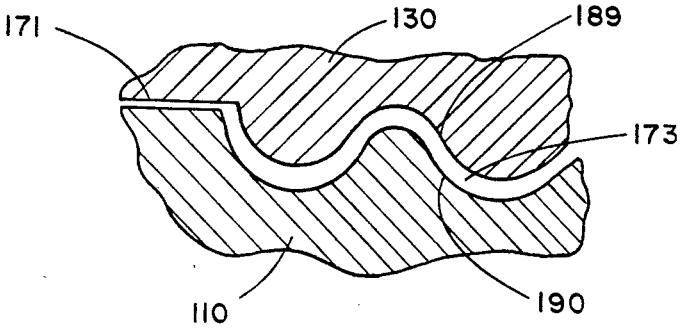

In FIG. 9, rollers 110 and 130 each are positioned in a spaced apart relationship in region 173 which extends along a portion of each roller. Each of rollers 110 and 130 are in roll contact in region 171; and surface 189 of roller 130 and surface 190 of roller 110 each form a somewhat sinusoidal shape longitudinally along end roller. The spaced apart relationship between the rollers, or the depressed depth of the somewhat sinusoidal shaped groove can vary, and generally ranges from about 0.004 inch to about 0.012 inch, with about 0.006 inch being preferred. The resulting sheet-like extender material having a wavy or corrugated-type profile can be employed in providing cut filler having an improved filling capacity.

Figure 10:
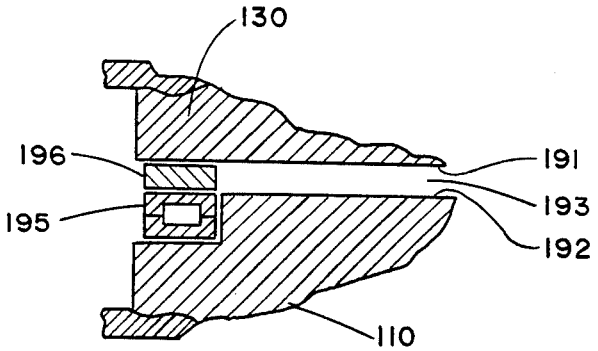

In FIG. 10 roller face 191 of roller 130 and roller face 192 roller 110 are positioned in a spaced apart relationship in region 193 along the longitudinal axis of each roller. The spaced apart relationship of the rollers is provided by idler bearings 195 which encircle each end of roller 110 and spacer ring 196 which encircles and is mounted to each idler bearing, or other such means. Machining of each end of the roller can be performed as required in order to provide the desired fit of idler bearing assembly and spacer ring. Roll contact is provided between the roll face of roller 130 and either a surface of the idler bearing assembly or the spacer ring encircling roller 110. The surface of the idler bearing assembly and encircling spacer ring extend longitudinally along a portion of that roller. Roller face 192 of roller 110 can be grooved, roughed, or smooth (as shown in FIG. 10). The spaced apart relationship of the rollers is a distance which approximates the thickness of sheet-like tobacco extender material, and generally the distance ranges from about 0.003 inch to about 0.007 inch, with about 0.004 inch being preferred. Of particular interest is the fact that for this embodiment the drive gears (not shown) which turn rollers 110 and 130 can be arranged in order that there is a linear speed differential between the roller surfaces of each of rollers 110 and 130. The linear speed differential between rotating rollers 110 and 130 will depend upon factors such as the character of the tobacco extender material being processed, the roller diameters, etc. Typically, linear speed differentials range from greater than 0 inches per minute, preferably greater than about 30 inches per minute, up to about 120 inches per minute, preferably up to about 60 inches per minute, for a pair of 4 inch diameter rollers. It is believed that an additional shearing action can be created between the rollers rotating at different linear speeds thereby providing the capability of producing a homogeneous and strong sheet.

Figure 11:
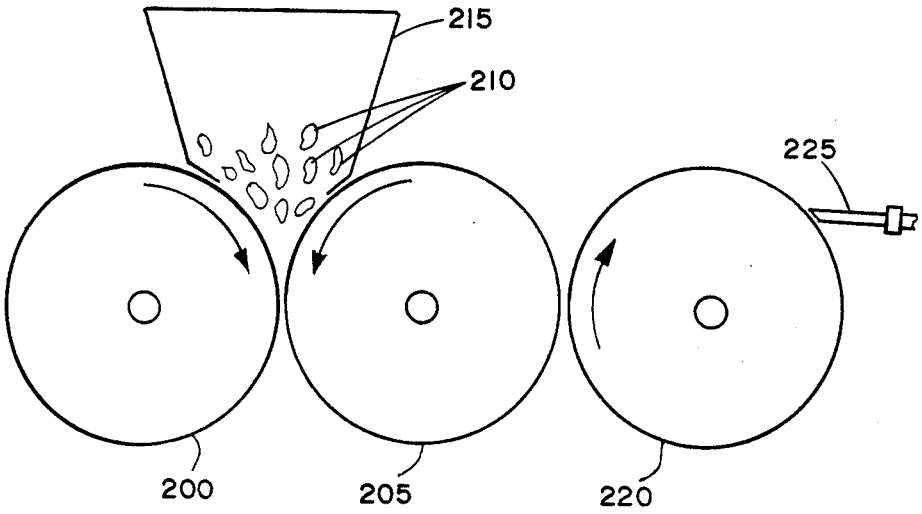
FIG. 11 is a diagrammatic illustration of one embodiment of a portion of the process of this invention showing three rollers which provide sheet form tobacco extender material.

FIG. 11 illustrates an apparatus for conducting a portion of the process of this invention. The sheet forming apparatus comprises 3 rollers in horizontal alignment and not in roll contact. The 3 rollers typically have substantially smooth surfaces, and are constructed from materials as described hereinbefore. First roller 200 and second roller 205 are rotated in directions opposite to one another such that filler material 210 in hopper 215 can pass through the nip thereof. Third roller 220 is rotated in a direction opposite to second roller 205 such that processed filler material passes through the nip thereof. Typically, first roller 200 is rotated at about 20 rpm to about 50 rpm; second roller 205 is rotated at a greater speed than the first roller; and third roller 220 is rotated at a greater speed than the second roller. The greater rotational speed of the second roller relative to the first roller provides the tendency for filler material to adhere to the second roller; and similarly the greater rotational speed of the third roller relative to the second roller provides the tendency for filler material to adhere to the third roller. Tobacco extender in sheet-like form is removed from the surface of the third roller using scrape 225 which extends along the roller face thereof. The rollers are supported by a frame (not shown) and are rotated using a power source (not shown) and a series of drive gears (not shown).

The tobacco extender which is provided according to the process of this invention can be provided generally in the form of a sheet. The sheet-like material exhibits good flexibility and tensile strength. Typically, the tobacco extender material in the form of a sheet exhibits a structural strength which approaches that of tobacco leaf. By the term "sheet" as used herein is meant that the tobacco material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet can range from about 0.005 inch to about 0.040 inch, preferably from about 0.010 inch to about 0.020 inch. The length and width of the sheet or strip of tobacco extender material can vary. The width of the sheet generally is determined by factors such as the longitudinal distance which the rollers of the second pressurized roller system are in a spaced apart relationship, the length of the means for removing the reclaimed tobacco material from the roller face of the roller of the second roller system, and the like. The sheet-like material exhibits good flexibility and tensile strength. The sheet can be cut as are tobacco leaf or wet formed reconstituted tobacco material (e.g., in strips of about 32 cuts per inch) and employed as cut filler in the manufacture of cigarettes.

The following examples are provided in order to further illustrate various embodiments of the invention but should not be construed as limiting the scope thereof. Unless otherwise noted, all parts and percentages are by weight.

EXAMPLE 1

Sheet form tobacco extender is provided from tobacco dust using the following procedure.

Into a Hobart-HMC-450 high shear mixer equipped with a stainless steel shaft 2 metal blades each having lengths of about 8 inches is placed 1 kg (100 parts) of essentially dry tobacco dust collected from a cigarette making machine. To the container is placed essentially dry form binding agent in the form of 9 parts sodium carboxymethylcellulose and 5 parts guar gum. The tobacco dust and binding agent each have a moisture content of about 6 percent. The mixer is jogged for about 15 seconds in order to mix (i.e., blend) the binding agent and tobacco dust. The mixture of binding agent and dust resembles dry clay. The mixer is then run and water is added to the container as mixing commences. Enough water is added to provide a mixture having a moisture content of 18 percent. The mixture is mixed at high shear agitation (i.e., about 1140 rpm) for about 5 minutes. The material so processed resembles slightly dampened clay. The resulting filler material which has been subjected to high shear agitation is processed further in order to provide sheet form tobacco extender.

A sheet forming apparatus which is generally described in FIGS. 2, 3, 4, 5 and 7 is provided. Roller 130 is constructed of hardened carbon steel, has a substantially smooth surface, and has a diameter of 4 inches and a roller face having a length of 4 inches. Roller 120 has a diameter of 4 inches and is of similar length and construction to roller 130; however, roller 120 contains grooves extending in a radial fashion about the periphery of said roller 120. Roller 120 comprises grooves in a 2 inch distance longitudinally along the roller face, and the 1 inch distance along the roller face at each end of the roller is relatively smooth. The grooved portion of roller 120 is generally described in FIG. 4. The depth d of the grooves is about 0.009 inch, the pitch p of each groove is about 0.031 inch, and the angle A′ is about 90°. The top portion of each groove is flattened by a distance of about 0.008 inch, and the bottom of each groove is flattened by a distance of about 0.003 inch. Roller 110 is of a generally similar size and construction to roller 120. Roller 110 is generally described in FIGS. 5 and 7. A groove having a substantially smooth face extends 2 inches along the longitudinal length of the roller, and the 1 inch distance along the roller face at each end of the roller is not depressed and is relatively smooth. The depth d‴ formed by the spaced apart relationship is 0.010 inch. The rollers are operated using variable speed drive using a variable speed 1.5 horsepower electric motor at a speed of about 4 rpm, and a nip zone pressure of about 5000 pounds per linear inch is generated. The angle A provided by the central axis of roller 120, roller 110 and roller 130, respectively, is 150°. Scrape 156 in the form of a blade is positioned so as to remove the reclaimed tobacco material from roller 110. Force is provided to each of rollers 110, 120 and 130 by two compression rollers positioned in roll contact with each of rollers 110, 120, and 130. Each compression roller is positioned at one end of each of rollers 110, 120 and 130. The compression rollers are about 1 inch in longitudinal length and about 2 inches in diameter. Force is provided to the compression rollers by jack screws.

The resultant blend is introduced into the apparatus and a reclaimed tobacco material in the form of sheet is provided. The resulting sheet has a generally flat shape having a continuous length, a width of about 2 inches, and a thickness of about 0.018 inch.

EXAMPLE 2

Sheet form tobacco extender is provided from a blend of tobacco material and carbonized material using the following procedure.

Into a plastic bag is placed about 2 kg (75 parts) of essentially dry, powder form carbonized material provided from tobacco stems; 75 parts of a blend of 50 parts essentially dry tobacco dust and 50 parts Winnower throw stems from a Molins MK9 Cigarette Maker; 0.5 parts xanthan gum and 0.5 parts locust bean gum. The materials are hand mixed in the bag and water is atomized slowly into the bag during the mixing. Enough water is added to provide a mixture having a moisture content of 15 percent. The material is allowed to sit for after hand mixing for about 30 minutes. The mixture is removed from the bag and transferred to a vibrating hopper which feeds a twin screw extruder. The twin screw extruder comprises a constant pitch metal screw 16 inches long. The diameter of the screw is 1.5 inch and flights are positioned along the length of the screw at a 2 inch pitch. The single screw extruder feeds into a pressurized roller system. The extruder and roller system is a commercially available TS-10 Roll Press supplied by Material Processing Corporation, Amherst, Ill., USA. The tobacco material/binding agent mixture is passed through the screw extruder which is run at about 30 rpm using a 1.5 hp motor. The temperature within the barrel is stabilized at about 85° F. The mixture is passed from the extruder through a metal die having a rectangular die opening of 0.25 inch by 1.5 inch. The filler material and binding agent mixture which has been subjected to high shear is fed from the die directly through the nip of two rollers which are in roll contact and form a pressured roller system. The rollers each are generally cylindrical and have a 6 inch diameter and a longitudinal length of 1.5 inch. The two rollers are held in roll contact using jack screws, and a separating force of 30,000 pound is generated between the rollers. The force between the rollers is lowered in an amount to provide sheet production. Both of the rollers have a substantially smooth roll face. The rollers are operated at a roll speed of from about 10 to about 72 rpm.

Reclaimed tobacco extender material in sheet form is provided from the filler material which passes through the rollers. Sheets are provided by scraping the reclaimed material from the roller using a doctor blade which extends along the width of the roller face.

EXAMPLE 3

Sheet form tobacco extender is provided using the materials, process and apparatus described in Example 2; however, the temperature within the barrel of the extruder is stabilized at 180° F. rather than 85° F.

EXAMPLE 4

Sheet form tobacco extender is provided from carbonized material using the following procedure.

Into the mixing container of the high speed mixer described in Example 1 is placed 100 parts carbonized material, 1 part locust bean gum and 1 part xanthan gum. The mix is jogged for about 15 seconds in order to mix the binding agent and filler material. The high shear mixer is then run and enough water to provide a mixture having a moisture content of 20 percent is added to the container as mixing commences.

The resulting filler which has been subjected to high shear agitation is processed further in order to provide sheet form tobacco extender.

The apparatus is generally described in FIGS. 2, 3, 4 and 10.

Roller 130 has a substantially smooth surface. Roller 120 has a series of grooves therein as shown in FIG. 4. Roller 120 has grooves extending about 2 inches along the roller face, and the 1 inch distance along the roller face of each end of the roller is relatively smooth. A cross section of roller 120 is generally described in FIG.

4. Roller 120 has a groove depth d of 0.009 inch, pitch p of 0.031 inch, a flattened top portion 172 of 0.008 inch, and a flattened bottom portion 174 of 0.003 inch. Roller 110 is equipped at each end thereof with an idler bearing assembly and spacer ring generally as described in FIG. 10. Each idler bearing assembly and circumscribing spacer ring provides a spaced apart relationship of 0.003 inch between the roller faces of rollers 110 and 120 in the 2 inch region along the grooved roller face of roller 120. Roller 110 is rotated at a linear differential speed of from 33.7 inches per minute to 118.8 inches per minute greater than that of each of roller 120 and roller 130 surfaces, during the processing of the filler material. The filler material is passed through the nip of rollers 120 and 110, and then through the nip of rollers 130 and 110.

The sheet-like tobacco extender is scraped from roller 110 using flat scrape 156, and has dimensions of 2 inches wide and 0.01 inch thick.

EXAMPLE 5

Sheet form tobacco extender is provided from a blend of tobacco material and carbonized material as follows.

Into the mixing container of the high speed mixer described in Example 1 is placed 25 parts carbonized material, 75 parts essentially dry tobacco dust, 1 part xanthan gum and 1 part locust bean gum. The mix is jogged for about 15 seconds in order to mix the binding agent and filler material. The high shear mixer is then run and water is added to the mixture as mixing commences. Enough water is added to provide a mixture having a moisture content of 15 percent. The high shear mixing is continued for 3 minutes.

The resulting filler material is processed using the pressurized roller system described in Example 1 in a manner substantially as described in Example 1. The resulting sheet has a width of 1.5 inch and thickness of 0.02 inch.

EXAMPLE 6

Sheet form tobacco extender is provided from tobacco dust using the following procedure.

Into the mixing container of the high speed mixer described in Example 1 is placed 100 parts tobacco dust, 9 parts sodium carboxymethylcellulose, and 5 parts guar gum. The mixer is jogged for about 15 seconds in order to mix the binding agent and tobacco dust. The mixer is then run and water is added to the mixer as mixing commences. Enough water is added to provide a mixture having a moisture content of 18 percent. The mixture is subjected to high shear agitation for about 5 minutes. The resulting filler material is processed further to provide sheet form tobacco extender.

The sheet forming apparatus is generally described in FIG. 11. The apparatus is a roll mill sold commercially as Kent Model 4"×8" Lab, High-Speed, 3 Roll Mill by Chas. Ross & Son Co., Hauppauge, N.Y., USA. The apparatus comprises 3 rollers each having a substantially smooth roll face. The rollers each have a longitudinal length of 8 inches and a diameter of 4 inches. The rollers are positioned in a horizontal position with their roll faces parallel to one another. The spacing between the roll faces is adjusted to about 0.005 inch. The filler material is transferred to the hopper which feeds said material to the zone between the first 2 rollers. The first roller is rotated at a roll speed of 30 rpm. The second roller is rotated at a roll speed of 3 times that of the first roller (i.e., 90 rpm). The material passes between the rollers and then passes between the second and third rollers. The third roller is rotated at roll speed of 3 times the second roller (i.e., 270 rpm). The extender material is collected from the third roller using a doctor blade positioned along the roll face of the third roller near the extreme vertical portion of the roller. The extender material is a continuous sheet, 8 inches in width and having a thickness between about 0.01 inch and about 0.03 inch.

What is claimed is:

1. A process for providing tobacco extender in sheet-like form, said process comprising the steps in combination (a) providing filler material in the form of tobacco material and/or carbonized material, and (b) providing in essentially dry, substantially non-binding form binding agent which is capable of being activated, and (c) contacting the filler material and the binding agent, and then (d) subjecting the filler material and binding agent to high shear agitation (i) in the presence of sufficient moisture to provide activation of the binding agent but in the presence of a moisture content of less than about 30 weight percent based on the total weight of moisture and filler material, and (ii) for a period of time sufficient to activate the binding agent, and then (e) forming sheet-like tobacco extender from the filler material so subjected to high shear agitation.

2. The process of claim 1 wherein flavorant is incorporated into the filler material so subjected to said high shear agitation prior to forming tobacco extender from the filler material so subjected to high shear agitation.

3. The process of claim 2 wherein said flavorant is water soluble and/or temperature sensitive.

4. The process of claim 1 wherein said sheet-like tobacco extender is formed from the filler so subjected to high shear agitation by (i) passing the filler material through the nip of a first pressurized roller system having two rollers exhibiting a nip zone pressure sufficient to provide compression of said filler material thereby providing compressed, admixed filler material, wherein at least one of the roller faces comprises a series of grooves, said series extending longitudinally along the roller and each groove extending about the periphery of the roller, wherein each groove has a maximum width near the surface of the roller and a minimum width near the bottom of the groove, and then (ii) forming under pressure tobacco extender in sheet-like form by passing the compressed, admixed filler material through the nip of a second pressurized roller system having two rollers exhibiting a nip zone pressure sufficient to provide the tobacco extender.

5. The process of claim 4 wherein each of said grooves is generally "V" shaped.

6. The process of claim 4 wherein said second pressurized roller system has two rollers exhibiting a nip zone pressure sufficient to provide the tobacco extender, wherein the roller faces of the rollers are positioned in a spaced apart relationship in the region along the rollers where the reclaimed tobacco material is formed, and wherein the spaced apart relationship between the faces of the rollers provides a sufficient distance therebetween to provide formed sheet-like tobacco extender.

7. The process of claim 1 wherein the tobacco filler material so subjected to high shear agitation exhibits a moisture content between about 15 weight percent and about 18 weight percent, based on the dry weight of the filler material and total moisture.

8. The process of claim 1 wherein the tobacco filler material so subjected to high shear agitation exhibits a moisture content between about 14 weight percent and about 25 weight percent, based on the dry weight of the filler material and total moisture.

9. The process of claim 1 wherein binding agent is a mixture of locust bean gum and xanthan gum.

10. The process of claim 1 wherein said filler material is tobacco material.

11. The process of claim 1 wherein said filler material is carbonized material.

12. The process of claim 1 wherein said filler material is a combination of tobacco material and carbonized material.

13. The process of claim 1 wherein said binding agent is capable of being moisture activated.

14. The process of claim 1 wherein the amount of binding agent is less than about 15 weight percent, based on the total weight of binding agent, moisture and filler material dry weight.

15. The process of claim 1 wherein said filler material and binding agent are subjected to the high rate of shear agitation at a temperature in the range from about 65° F. to about 110° F.

16. The process of claim 1 wherein said filler material and binding agent are subjected to mixing prior to being subjected to high shear agitation.

17. The process of claim 1 wherein said high shear agitation is provided by a Hobart HMC-450 mixing device providing an agitation rate of greater than about 800 rpm for about 3 minutes.

18. The process of claim 1 wherein said high shear agitation is provided by a Hobart HMC-450 mixing device providing an agitation rate of greater than about 1100 rpm for about 3 minutes.

19. The process of claim 4 wherein said nip zone pressures range from about 3,000 pounds per linear inch to about 10,000 pounds per linear inch.

20. The process of claim 1 wherein said high shear agitation is provided by a screw extruder.

* * * * *

UNITED STATES PATENT AND TRADEMARK OFFICE

CERTIFICATE OF CORRECTION

PATENT NO. : 4,730,629

DATED : March 15, 1988

INVENTOR(S) : Graves, Jr. et al

It is certified that error appears in the above—identified patent and that said Letters Patent is hereby corrected as shown below:

Column 10, line 59, after "1/50" insert --inch--.

Column 14, line 62, after "shaft" insert --and--.

Column 16, line 12, "single" should be --twin--.

Signed and Sealed this

Thirteenth Day of March, 1990

*Attest:*

JEFFREY M. SAMUELS

*Attesting Officer*

*Acting Commissioner of Patents and Trademarks*